US006502725B1

(12) United States Patent
Alexander

(10) Patent No.: US 6,502,725 B1
(45) Date of Patent: Jan. 7, 2003

(54) BEVERAGE DISPENSER

(75) Inventor: Tony M. Alexander, Six Mile, SC (US)

(73) Assignee: L. Ken Alexander, Aubrey, TX (US)

( * ) Notice: Subject to any disclaimer, the term of this patent is extended or adjusted under 35 U.S.C. 154(b) by 0 days.

(21) Appl. No.: 10/071,334

(22) Filed: Feb. 8, 2002

(51) Int. Cl.[7] ..... B67D 5/06

(52) U.S. Cl. ..... 222/185.1; 222/481.5; 222/484; 222/105

(58) Field of Search ..... 222/94, 95, 185.1, 222/465.1, 481, 484, 518, 481.5, 105

(56) References Cited

U.S. PATENT DOCUMENTS 2,270,383 A * 1/1942 Norton et al. ..... 222/185.1
4,279,363 A * 7/1981 Alikhan ..... 222/94
4,809,884 A * 3/1989 Stackhouse ..... 222/95
4,911,334 A * 3/1990 Kedzierski ..... 222/185.1
5,024,353 A * 6/1991 Horne ..... 222/185.1
5,405,058 A * 4/1995 Kalis et al. ..... 222/185.1
5,848,736 A * 12/1998 Boumann ..... 222/185.1

* cited by examiner

*Primary Examiner*—Philippe Derakshani
(74) *Attorney, Agent, or Firm*—J. Herbert O'Toole; Nexsen Pruet Jacobs & Pollard, LLC

(57) ABSTRACT

A dispensing device for a beverage container, preferably a large bottle such as a 2 or 3 liter soda pop bottle has a base and separate pathways to admit make-up air and withdraw fluid. The pathways are controlled by a valve which opens the pathways separately. This invention is especially characterized by the use of an expandable bladder to prevent loss of carbonation into the headspace.

8 Claims, 4 Drawing Sheets

BEVERAGE DISPENSER

BACKGROUND OF THE INVENTION

1. Field of the Invention

This invention relates to devices for dispensing beverages from large containers, particularly plastic bottles and more particularly devices to prevent loss of carbonation in carbonated beverages after the container has been opened.

2. Background and Prior Art

Large beverage containers of two liters or more recently have become popular. Carbonated beverages in bottles made of polyethylene terephthalate (PET) are widely used for reasons of convenience and cost. The bottles are light in weight and essentially unbreakable but when open over a period of several days, loss of carbonation may become a problem. This is due to equilibration of carbon dioxide between the liquid and the void volume in the bottle, which is essentially by air. This problem is exacerbated if the product warms.

In soda fountains and pubs, systems to introduce carbon dioxide into a beverage are conventional. Such systems are typically not used in homes for reasons of cost and complexity. It remains desirable, however, to prevent loss of carbonation from carbonated drinks to maintain their palatability.

U.S. Pat. No. 262,773 to Hohl discloses a method for lifting a malt beverage from a keg using a gas or liquid forced into a bladder inserted through the bung hole. U.S. Pat. No. 3,244,326 discloses a miniature beer keg having a pressure relief valve at an end opposite to a tap for the admission of make-up air as the contents of the keg are drawn off. U.S. Pat. No. 4,911,334 discloses a device for draining an inverted bottle employing a pair of valves, one of which is a drain valve and the other of which admits air to the top portion of the bottle to prevent gurgling during drainage. U.S. Pat. No. 4,722,463 provides a device similar to U.S. Pat. No. 4,911,334 but for a bottle mounted at an angle, not vertically, and supplements the invention by use of a flexible tube to admit air and the use of a float on the end of said tube to assure it's presence at the top or head space of a bottle. U.S. Pat. No. 4,809,884 discloses a method for lifting wine by means of an expandible interior bladder and an external pump. U.S. Pat. No. 4,930,666 discloses a valve assembly adapted for use with an inverted juice container mountable in the door of a refrigerator and employing a two part valve incorporating a vent tube to admit air into the container as the juice is withdrawn. U.S. Pat. No. 5,024,353 is directed to a valve and cradle system for dispensing soda from two and three liter plastic bottles while the bottle remains within a refrigerator and employs a two channel valve. The sliding valve includes a vent tube for admitting make-up air into the bottle. U.S. Pat. No. 6,073,811 discloses a cradle and a valve system for lifting carbonated beverages which includes a $CO_2$ cartridge for pressurizing the soda bottle. U.S. Pat. No. 6,220,311 discloses a container for carbonated beverages having an internal bladder which is pressurized to decrease or eliminate void volume by filling with water or air and which employs a second spout at the head of the container.

The prior art fails to disclose a simple device which prevents the admission of air into a partially drained container of carbonated beverage except by requiring a specialized container distinct from bottles in which carbonated beverages are sold in stores.

BRIEF SUMMARY OF THE INVENTION

It is a first object of this invention to provide a method and apparatus for preventing a loss of carbonation in an opened container of carbonated beverage. It is a second objective of this invention to provide a method and apparatus for holding an opened container of carbonated beverage in a refrigerator or on a table. It is a third objective of this invention to provide a means for dispensing carbonated beverage from a refrigerator or table without moving the beverage container.

These and other objectives of this invention may be achieved by providing a base having mounted therein a valve mechanism and which receives the threads of a beverage bottle and by providing, in communication with at least one additional valve, a vent tube passing into at least a portion of the length of the container, the tube being surrounded by a flexible material which serves to separate the carbonated beverage from the make-up air.

DETAILED DESCRIPTION OF THE INVENTION

The device according to this invention provides a means for making up the void volume in a partially empty beverage container, especially a beverage container with carbonated beverages which prevents the formation of a head space filled with atmospheric air in which the carbon dioxide in the liquid will equilibrate. The invention is illustrated in terms of a conventional two liter PET soda bottle, but the invention is also applicable to other beverages such as sparkling wine and beer and other size containers.

The device consists of a base which contains a valving system and a manifold through which liquid may be channeled to an external port for pouring into a cup, glass, etc. The second port, also controlled by the valving mechanism, admits make-up air into the container but does so through a tube which is encased in a flexible material so as to form a bladder as air is admitted. A bottle may be mounted on the base by simply threading the base onto the formed threads of the bottle. Alternatively, a slip-nut type fitting could be used.

Figure 1:
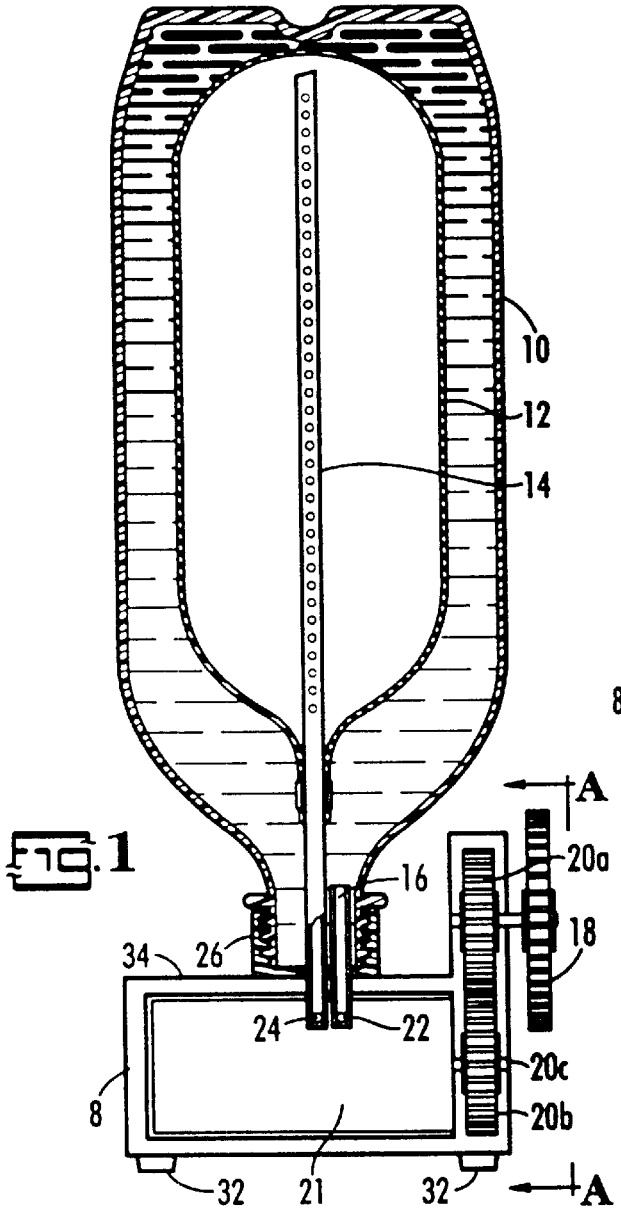
FIG. 1 is a cross-sectional cut-away of the device of this invention.

FIG. 1 shows a cross-section of a first embodiment of the invention. Base 8 receives bottle 10 using a threaded connector 26. A vent port 24 connects with tube 14 which may have one or more perforations. Flexible bladder 12 is sized to fit loosely around tube 14 and is made of flexible material expandable sufficiently that it will fill most of the volume of bottle 10. Preferably, the bladder begins at some distance from the mouth of the bottle so that the distended bladder will not block the mouth of the bottle. A drain port 22 enters the mouth of the bottle through tube 16 somewhat offset from the center line to withdraw the liquid contents of the container.

Figure 2:
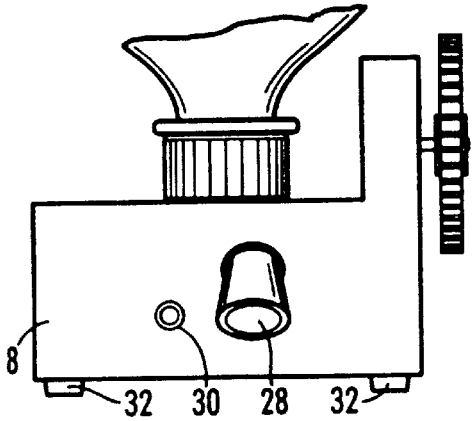
FIG. 2 shows the inlet and outlet ports of the device in side elevation.

A pair of outlets are provided on a side of base 8, as shown in FIG. 2. Drink port 28 provides a straw which may be fixed or flexible. External vent port 30 is a bore through which makeup air may be introduced. The drink port 28 connects to drain port 22 and external vent port 30 connects to vent port 24 through the barrel of a stopcock 21 which may be straight or tapered. In the preferred embodiment, the stopcock is attached to a gear 20*b* which engages a second gear 20*a*. External wheel 18 turns gear 20*a* to rotate the stopcock. This arrangement provides access around wheel 18 for ease of rotation. Tension on stopcock 21 may be adjusted via set screw 20*c*.

Figure 3:
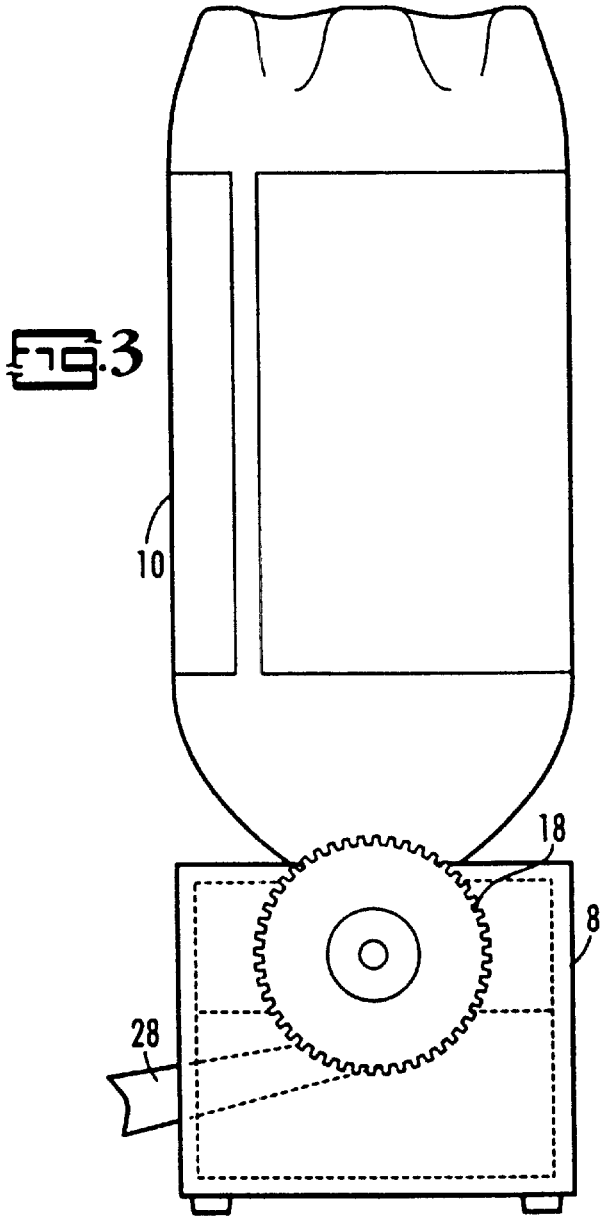
FIG. 3 shows the device of FIG. 1 along line A—A.
Figure 4:
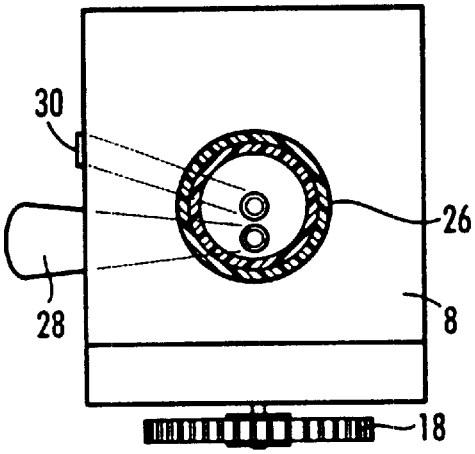
FIG. 4 shows a plan view of the base of the device.

FIG. 3 shows the base 8 of FIG. 1 along the line A—A. to show the relationship between external wheel 18 and drink port 28. FIG. 4 is a plan view of base 8 showing the relationships of external wheel 18, threaded connector 26, drink port 28 and vent port 30. The curvature shown is preferred to give the base a larger footprint and to centre the connector 26 and bottle 10.

As an alternative, external wheel 18 could be replaced with a lever rotating either gear 20*a* or 20*c*.

Figure 5:
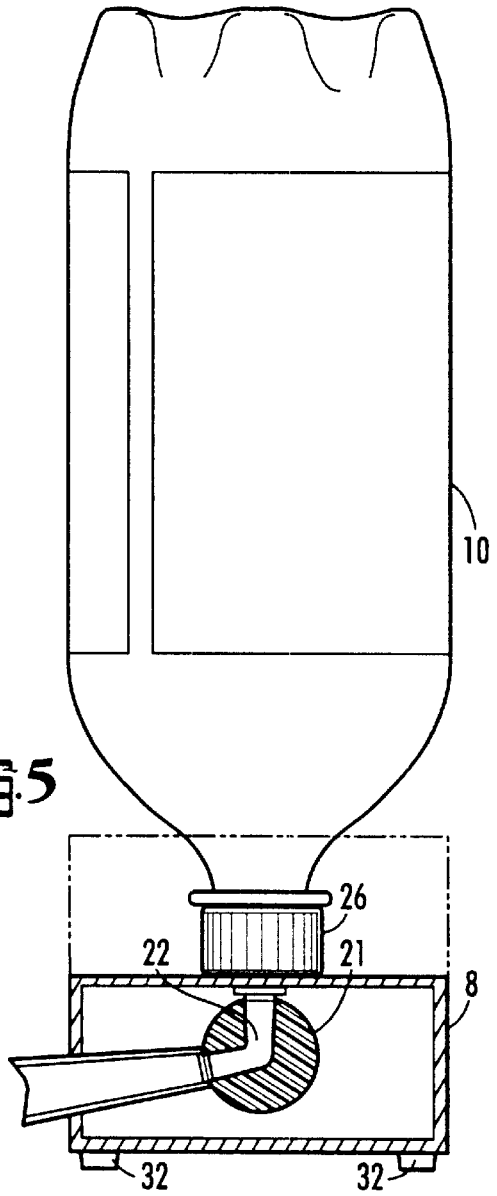
FIG. 5 is a cross-section of another drain valve system according to this invention.
Figure 6:
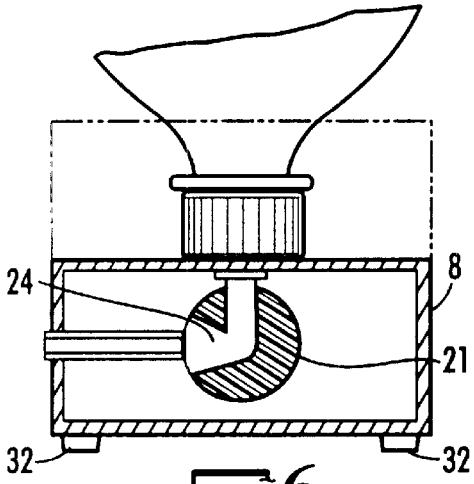
FIG. 6 shows a cross-section of an internal vent according to the invention.
Figure 7:
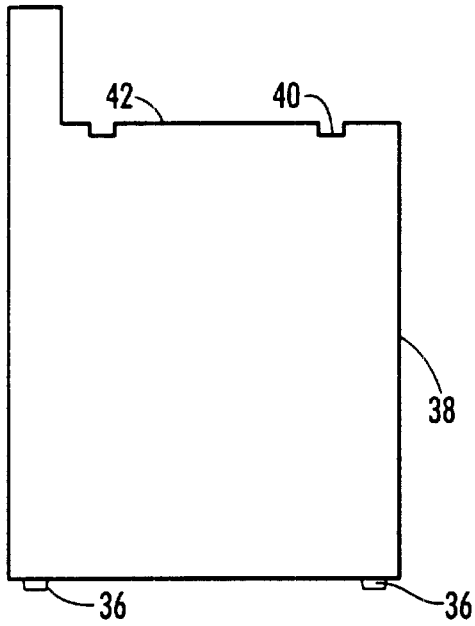
FIG. 7 shows a mounting stand to receive the device of this invention.

FIGS. 5 and 6 show the relative opening positions (or timing) of the valves for admission of air and drain of fluid in stopcock 21. The air inlet is always opened before the liquid drain and closes after the liquid drain so as to maintain the pressure within the bottle as close to ambient as possible. This is particularly important when the contents of the bottle have been cooled or heated, although altitude changes also could have a similar effect.

It is envisioned that the device would be used in a refrigerator essentially as illustrated in FIG. 1. When other locations are preferred, such as on a kitchen counter or a table, a stand 38 may be used in which feet 32 of the base would fit into notches 40. The base 8 would rest on flat surface 42. Additional set of rubber feet 36 would be used to prevent slipping. The height of stand 38 would correspond to the height of a water glass or similar container.

Figure 8:
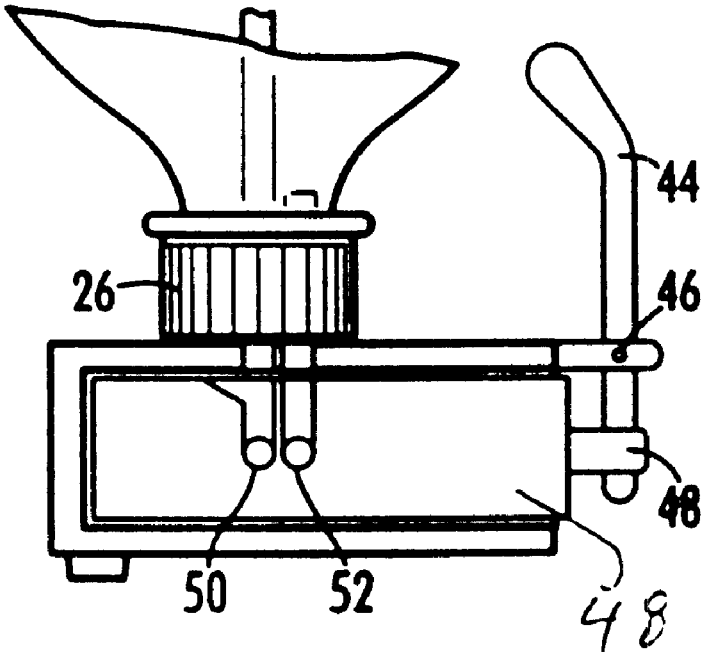
FIG. 8 is a cross-section of an alternative valve mechanism according to the invention.
Figure 9:
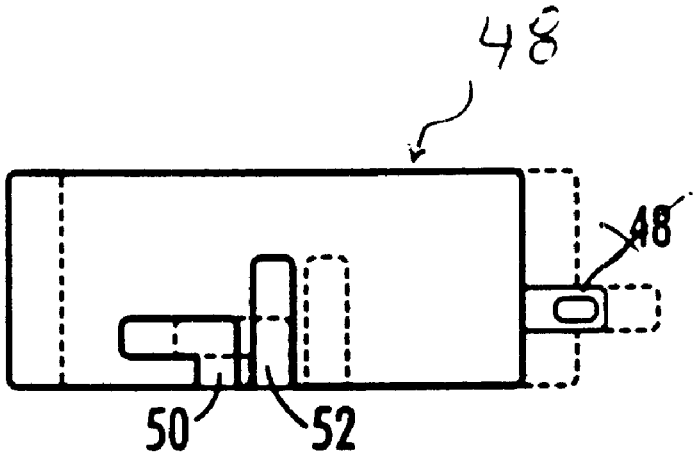
FIG. 9 is a valve mechanism of FIG. 8 along lines A—A.

FIGS. 8 and 9 illustrate an alternative valve system wherein a lever 44 having a fulcrum at hinge pin 46 slides valve 48 horizontally in and out of communication with the bottle and drain invent ports. FIG. 9 shows a top view along lines A—A. It is noted that this sliding throttle arrangement allows for opening of the vent 50 over a greater range of motion than of the drain portion 52.

Base 8 may be formed from any easily formed and machined material although it is preferably made from polypropylene. A weight may be molded into or attached to the base using adhesives and/or fasteners for additionally stability. The size of base 8 is not critical, larger dimensions being more stable but consuming additional refrigerator space.

The bladder is preferably formed from a latex based rubber for reasons of costs and flexibility.

For purposes of sanitation, it is preferred that the device be easily disassembled for cleaning.

The device may be made integrally with the door of a refrigerator. In such circumstances, the valves could be solenoid activated from the face of the door. Pneumatic control also could be used to activate the valves.

The invention has been shown in a configuration to receive a single bottle. When desired, two or more bottles could be mounted on a single, larger base with an appropriate valve for each bottle.

The invention has been described in terms of preferred embodiments which are not limitative of the invention. Modifications apparent to those skilled in the art are included within the scope of the invention, which will be further described in view of the appended claims.

I claim:

1. A dispensing device for beverage containers comprising:

a base having a hollow chamber;

at least one threaded connector attached to said base;

a drain port passing through said threaded connector and into said base to said hollow chamber;

a vent port passing through said threaded connector and into said base, to said hollow chamber, said vent port connecting with a tube having at an end distal to said base a flexible distendable bladder;

a drink port extending from said base and penetrating said base to said hollow chamber;

a vent connecting a surface of said hollow base to said hollow chamber; and a barrel-type stopcock capable of simultaneously connecting and disconnecting said drain port to said drink port and said vent port to said vent.

2. A dispensing device for beverage containers according to claim 1 wherein said tube extends beyond said drain port sufficiently to prevent said bladder from blocking entry to said drain port.

3. A dispensing device for beverage containers according to claim 1 wherein the stopcock has separate passageways for connecting said drain port and drink port and said vent port and vent.

4. A dispensing device for beverage containers according to claim 1 further comprising a stand to support said base.

5. A dispensing device for beverage containers comprising:

a base having a hollow chamber;

at least one threaded connector attached to said base;

a drain port passing through said threaded connector and into said base to said hollow chamber;

a vent port passing through said threaded connector and into said base to said hollow chamber, said vent port connecting with a tube having at an end distal to said base a flexible distendable bladder;

a drink port extending from said base and penetrating said base to said hollow chamber;

a vent connecting a surface of said hollow base to said hollow chamber; and a sliding plate throttle capable of simultaneously connecting and disconnecting said drain port to said drink port and said vent port to said vent.

6. A dispensing device for beverage containers according to claim 5 wherein said tube extends beyond said drain port sufficiently to prevent said bladder from blocking entry to said drain port.

7. A dispensing device for beverage containers according to claim 5 wherein the stopcock has separate passageways for connecting said drain port and drink port and said vent port and vent.

8. A dispensing device for beverage containers according to claim 5 further comprising a stand to support said base.

* * * * *